US009309616B2

(12) United States Patent
Bolduan et al.

(10) Patent No.: US 9,309,616 B2
(45) Date of Patent: Apr. 12, 2016

(54) LAUNDRY HANDLING APPARATUS WITH A CUFF AND A FILLING SUPPORT

(75) Inventors: Edwin Bolduan, Berlin (DE); Horst Wiemer, Kleinmachnow (DE)

(73) Assignee: BSH Hausgeräte GmbH, Munich (DE)

( * ) Notice: Subject to any disclaimer, the term of this patent is extended or adjusted under 35 U.S.C. 154(b) by 2232 days.

(21) Appl. No.: 12/317,276

(22) Filed: Dec. 19, 2008

(65) Prior Publication Data

US 2010/0154485 A1 Jun. 24, 2010

(51) Int. Cl.
*D06F 39/02* (2006.01)
*D06F 37/26* (2006.01)

(52) U.S. Cl.
CPC ..... *D06F 37/266* (2013.01); *D06F 39/02* (2013.01)

(58) Field of Classification Search
CPC ..... D06F 39/02
See application file for complete search history.

(56) References Cited

U.S. PATENT DOCUMENTS

| | | | | |
|---|---|---|---|---|
| 6,101,851 | A * | 8/2000 | Bolduan et al. | 68/17 R |
| 2004/0244438 | A1* | 12/2004 | North | 68/23.2 |
| 2007/0012074 | A1* | 1/2007 | Hong et al. | 68/12.21 |
| 2009/0293202 | A1* | 12/2009 | Bolduan et al. | 8/137 |

FOREIGN PATENT DOCUMENTS

| | | | |
|---|---|---|---|
| DE | 102006029953 | A1 * | 1/2008 |
| EP | 1 209 275 | | 5/2002 |

OTHER PUBLICATIONS

Bolduan et al., DE102006029953, Jan. 1998, English machine translation.*

* cited by examiner

*Primary Examiner* — Jason Ko
(74) *Attorney, Agent, or Firm* — Nixon & Vanderhye P.C.

(57) ABSTRACT

The invention relates to a laundry treatment device, which in particular serves as a washing machine or washer drier, having a housing and a container suspended in the housing. Also provided is an elastically deformable seal, which, is connected, on the one hand to the housing and, on the other, to the container. In addition, a dispenser housing with a filling connector is arranged in the housing. The seal has on a tubular projection an opening with one end of the filling connector being inserted into the seal at the opening of the seal.

21 Claims, 1 Drawing Sheet

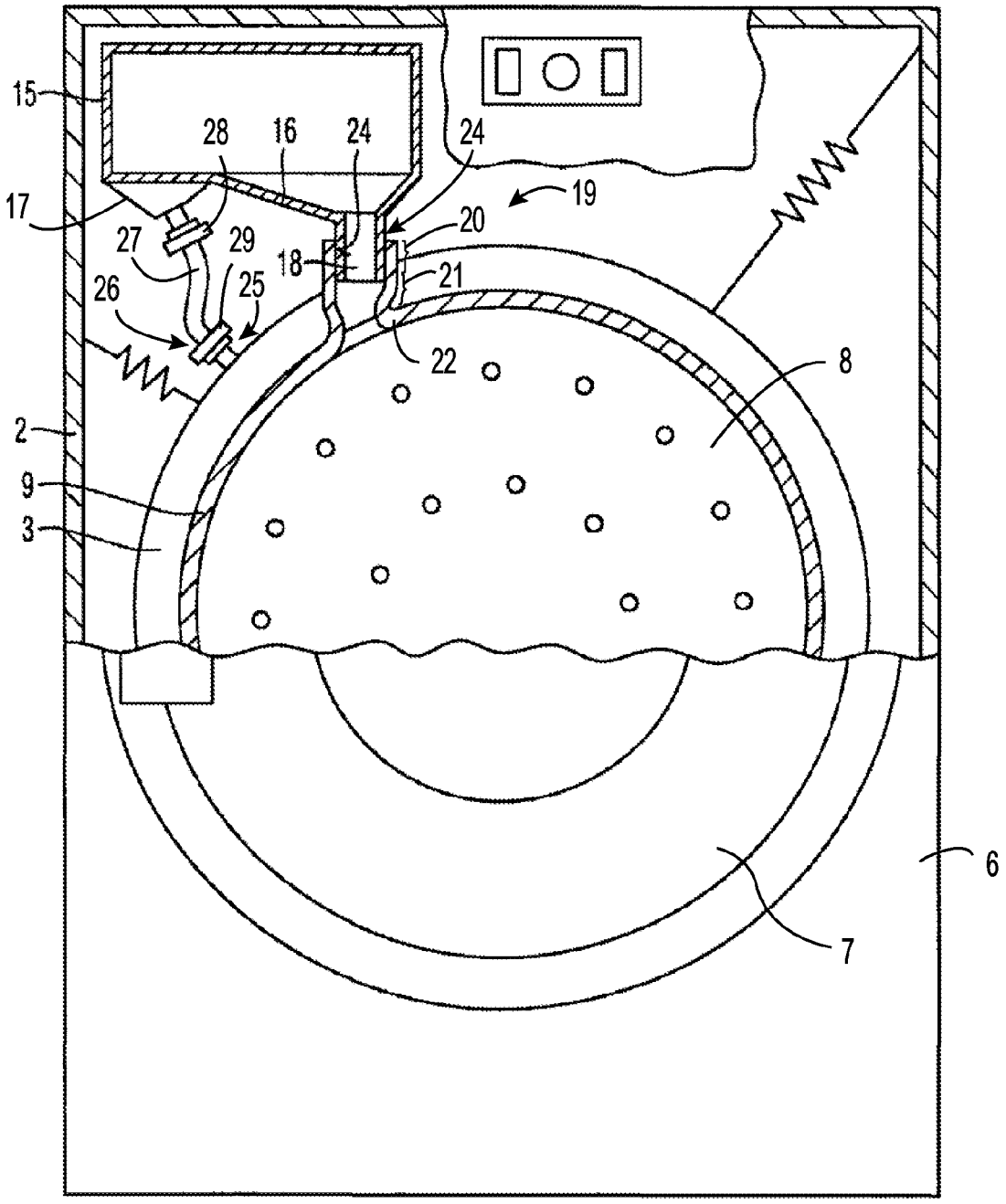
15
28
16
24
24
17
19
20
27
29
18
21
26
25
22
8
2
9
3
6
7

LAUNDRY HANDLING APPARATUS WITH A CUFF AND A FILLING SUPPORT

BACKGROUND OF THE INVENTION

The invention relates to a laundry treatment device, in particular a laundry treatment device for washing and/or drying laundry. The invention relates in particular to the field of washing machines and washer driers.

Known from EP 1 209 275 A2 is a washing machine. Provided with the known washing machine is a drum-shaped lye container in which a laundry drum is rotatably mounted about a horizontal axis. The lye container can be supplied with water via a pipe, a solenoid valve and a detergent dispensing device. This enables a certain water level to be achieved in the lye container. In addition to this, a drain pipe is connected to the floor of the lye container leading via a lint filter to the suction side of a drain pump. A drain hose is connected to the discharge side of the drain pump.

SUMMARY OF THE INVENTION

The washing machine known from EP 1 209 275 A2 has the drawback, that a durable connection of the lye container to the detergent dispensing device for supplying water is relatively complicated. During the operation of the washing machine, in particular during a spin cycle, the lye container is exposed to vibrations or oscillations, while the detergent dispensing device is arranged in a fixed position in the washing machine. Hereby, it is conceivable for a flexible inlet hose to be provided for the connection of the lye container to the detergent dispensing device, for example, said hose being connected by means of hose clamps on one end to a suitable connector on the lye container and on the other end to a suitable connector on the detergent dispensing device.

It is an object of the invention to provide a laundry treatment device in which the embodiment of the flushing-in is improved. In particular, it is an object of the invention to provide a laundry treatment device with which the flushing-in of water and/or laundry treatment agents is improved.

These objects are achieved by a laundry treatment device according to the invention, in particular a washing machine or washer drier, with a housing, a container suspended in the housing, an elastically deformable seal, which is connected on the one hand at least indirectly to the housing and on the other at least indirectly to the container, and at least one filling connector, with the seal comprising an opening and with one end of the filling connector being inserted in the seal at the opening in the seal.

In an advantageous way, a connection of a dispenser housing with the container, which may be embodied as a lye container, can be simplified. This connection does not require a flexible inlet hose. It is also possible to save on hose clamps. This also enables the assembly of the laundry treatment device to be simplified.

In addition, in an advantageous way, there can be an improved supply of water and/or laundry treatment agents. In particular, it is possible for water and/or laundry treatment agents to be supplied directly into the interior of a rotatable drum arranged in the container. This can improve the action of the laundry treatment agent on the laundry.

In an advantageous way, the seal comprises a tubular projection on which the opening of the seal is embodied, with at least a section of the end of the filling connector being inserted in the tubular projection of the seal. When the filling connector is connected to the tubular projection of the seal, the tubular projection is preferably slightly widened, i.e. expanded, in order to create a reliable connection between the seal and the filling connector. A hose clamp can hereby be omitted. The flexible, elastic embodiment of the seal causes oscillatory motions of the container that occur during operation to be compensated so that a reliable connection is guaranteed between the seal and the filling connector. Hereby, it is also advantageous for the tubular projection to be embodied as relatively long and for only a section of the filling connector to be inserted in the relatively long, tubular projection of the seal. The remaining section of the tubular projection can achieve additional flexibility in the region of the attachment of the seal in order to compensate motions transmitted from the container to the seal, in particular oscillatory motions.

It is advantageous for a dispenser housing to be provided and for the filling connector to be connected to the dispenser housing or for the dispenser housing to encompass the filling connector. Preferably, the dispenser housing encompasses the filling connector, so that the filling connector is an integral component of the dispenser housing. However a multi-part embodiment is also possible.

In an advantageous way, the filling connector is provided in a front region of the dispenser housing, which is arranged on a front side of the housing. Hereby, it is further advantageous for the seal to be arranged in the housing in the region behind a front side of the housing. In particular, the seal is arranged in the region behind a front side of the housing on which a door is provided for loading and unloading the laundry treatment device.

In an advantageous way, exactly one outlet is provided for the dispenser housing which is formed by the filling connector. This permits a cost-effective embodiment of the laundry treatment device.

However, it is also possible for a first outlet to be provided for the dispenser housing, which is formed by the filling connector, and for at least one second outlet to be provided for the dispenser housing comprising an inlet hose connected to the container. This enables, for example, a laundry treatment agent to be dispensed via the first outlet and a further laundry treatment agent to be dispensed via the second outlet. For example, a powdery laundry treatment agent can be flushed-in in a conventional way via the second outlet, while a liquid laundry treatment agent, in particular a laundry care agent, is flushed in via the first outlet.

BRIEF DESCRIPTION OF THE DRAWINGS

Exemplary embodiments of the invention are explained in more detail in the following description with reference to the attached drawing which shows:

FIG. 1 a laundry treatment device in a schematic, partial sectional view corresponding to an exemplary embodiment of the invention.

DETAILED DESCRIPTION OF EXEMPLARY EMBODIMENTS OF THE PRESENT INVENTION

FIG. 1 shows a laundry treatment device 1 in a schematic, partial sectional view corresponding to an exemplary embodiment of the invention. The laundry treatment device 1 can in particular serve as a washing machine for washing laundry or as a washer drier for washing and drying laundry.

The laundry treatment device 1 has a housing 2 and a container 3 arranged in the housing 2. The container 3 is hereby embodied as a lye container 3. The lye container 3 is connected to the housing 2 by means of spring elements 4, 5 and thereby resiliently suspended in the housing 2. Hereby, preferably, several spring elements are provided of which FIG. 1 depicts the spring elements 4, 5.

The housing 2 of the laundry treatment device 1 has a front side 6. FIG. 1 shows the housing 2 partially open at the front side 6. Arranged on the front side 6 of the housing 2 is a door 7 which can be opened and then closed again for loading and unloading a drum 8 arranged in the lye container 3. During the operation of the laundry treatment device 1, the drum 8 rotates about a horizontal axis. The resiliently suspended lye container 3 can be induced to oscillate during a rotation of the drum 8 of this kind. This is generally caused by an imbalance, i.e. a non-uniform distribution of the laundry in the drum 8.

The drum-shaped lye container 3 is connected to the housing 2 by means of a seal 9 in the region of the door 7. Hereby, the seal 9 is connected on the one hand at least indirectly to the housing 2 and on the other at least indirectly to the lye container 3. These connections can hereby each be embodied directly or by means of suitable elements.

The seal 9 is made of a flexible, elastic material. Hereby, the seal 9 can comprise several folds or the like in order further to improve flexibility by a geometric embodiment of the membrane 9.

In addition, a dispenser housing 15 is arranged in a fixed position in the housing 2. The front side 6 of the housing 2 has in the region of the dispenser housing 15 an opening in order to introduce a suitable dispenser (not shown) into the dispenser housing 15. A dispenser of this kind can accommodate one or more laundry treatment agents. During the operation of the laundry treatment device 1, one or more flushing-in processes can take place in which water and/or laundry treatments agent are supplied to the laundry in the drum 8.

In this exemplary embodiment, the dispenser housing 15 has a first filling connector 16 and a second filling connector 17. Depending upon the embodiment of the laundry treatment device 1, the second filling connector 17 can also be omitted. The filling connectors 16, 17 are integral components of the dispenser housing 15. This facilitates the cost-efficient manufacture and assembly of the laundry treatment device 1. The first filling connector 16 has an end 18 to which water and laundry treatment agents flow from the filling connector 16 of the dispenser housing 15.

The seal 9 has a tubular projection 19. The end 18 of the filling connector 16 is inserted in a section 20 of the tubular projection 19. In addition, the tubular projection 19 has a section 21. The tubular projection 19 of the seal 9 extends from a base body 22 of the seal 9 to the end 18 of the filling connector 16. Hereby, the section 21 of the tubular projection 19 creates a certain spacing between the end 18 of the filling connector 16 and the base body 22 of the seal 9. The base body 22 already ensures a certain decoupling of the filling connector 16 from the lye container 3. The section 21 achieves an additional decoupling. This enables a reliable connection to be achieved between the end 18 of the filling connector 16 and the section 20 of the tubular projection 19 of the seal 9 throughout the lifetime of the laundry treatment device 1. Hereby, the section 20 of the tubular projection 19 is preferably slightly expanded during assembly. A connecting clamp or the like can hereby be omitted.

The filling connector 16 is arranged in a front region 23 of the dispenser housing 15 and therefore relatively close behind the front side 6 of the housing 2. This enables the filling connector 16 to be embodied as relatively short. During the flushing-in of water and/or laundry treatment agents via the filling connector 16, the water with the laundry treatment agent goes directly to the drum 8. This allows the wetting or action on the laundry to be improved. The seal 9 is also located in the region behind the front side 6 of the housing 2.

In this exemplary embodiment, an opening 24 of the seal 9 is embodied on the tubular projection 19. The end 18 of the filling connector 16 is inserted in the seal 9 on the opening 24 formed by the tubular projection 19. However, the opening 24 of the seal 9 can also be embodied in a different way. In particular, the tubular projection 19 can also be omitted. In this case, the opening 24 can be formed, for example, by a cylindrical recess in the base body 22 of the seal 9.

In this exemplary embodiment, the dispenser housing 15 also comprises the second filling connector 17. The lye container 3 is embodied as rigid with a filling connector 25 being embodied on the lye container 3. An end 26 of the filling connector 17 is connected to the filling connector 25 by means of an inlet hose 27. The inlet hose 27 is hereby embodied flexibly and elastically in order to decouple the dispenser housing 15 from the lye container 3. The oscillatory motions of the lye container 3 during the operation of the laundry treatment device 1 cause relatively high forces on the connecting points between the inlet hose 27 and the end 26 of the filling connector 17 or the filling connector 25. To ensure a reliable connection, therefore, hose clamps 28, 29 are provided at these connecting points.

Via the second filling connector 17, water and/or laundry treatment agent, in particular powdery laundry treatment agents can be supplied in a conventional way to the lye container 3. However, the second filling connector 17 can also be omitted. In this case, all the laundry treatment agents are supplied via the first filling connector 16.

The invention is not restricted to the exemplary embodiments described.

The invention claimed is:

1. A laundry treatment device comprising:

a housing:

a container suspended in the housing;

an elastically deformable seal connected to the housing and to the container and comprising an opening; and a dispenser housing having an integral filling connector, said filling connector having an end inserted into the seal at the opening of the seal such that a surface of the filling connector is in direct contact with a surface of the seal, wherein the dispenser housing and the filling connector are formed in one piece with one another.

2. The laundry treatment device of claim 1, wherein the elastically deformable seal comprises an approximately tubular projection having the opening and wherein the filling connector end is inserted in the tubular projection of the seal.

3. The laundry treatment device of claim 1, wherein the filling connector is in a front region of the dispenser housing on a front side of the housing.

4. The laundry treatment device of claim 3, wherein the seal is in a region behind a front side of the housing within the housing.

5. The laundry treatment device of claim 1, wherein the dispenser housing is associated with only one said filling connector.

6. The laundry treatment device of claim 1, wherein the filling connector is for the dispenser housing which is connected via an inlet hose to the container.

7. The laundry treatment device of claim 1, wherein the filling connector is substantially in a fixed position in the housing.

8. The laundry treatment device of claim 1, wherein the container is suspended resiliently in the housing by spring elements and wherein the container encompasses a rotatable drum.

9. The laundry treatment device of claim 1, wherein the opening of the seal is in a region of the seal which is not dynamically stressed during operation.

10. The laundry treatment device of claim 1, without a bellows between the filling connector and the seal.

11. A laundry treatment device comprising:

a housing:

a container suspended in the housing;

an elastically deformable seal connected to the housing and to the container and comprising an opening; and a dispenser housing having an integral filling connector, said filling connector having an end inserted into the seal at the opening of the seal such that a surface of the filling connector is in direct contact with a surface of the seal;

wherein the elastically deformable seal comprises an approximately tubular projection having the opening and wherein the filling connector end is inserted in the tubular projection of the seal; and wherein the tubular projection includes a section that extends from a base body of the seal, and wherein the section creates a spacing between an edge of the filling connector and the base body, to decouple the filling connector from the container.

12. A laundry treatment device comprising:

a housing:

a container suspended in the housing;

a seal connected to the housing and to the container and comprising an approximately tubular projection having an opening; and a dispenser housing having a filling connector, said filling connector extending from the dispenser housing to the opening such that a surface of the filling connector directly contacts a surface of the seal adjacent the opening; and wherein the tubular projection includes a section that extends from a base body of the seal, and wherein the section creates a spacing between an edge of the filling connector and the base body, to decouple the filling connector from the container.

13. The laundry treatment device of claim 12, wherein the dispenser housing and the filling connector are integral.

14. The laundry treatment device of claim 12, wherein the dispenser housing and the filling connector are separate parts connected to one another.

15. The laundry treatment device of claim 12, wherein the filling connector includes an end that is inserted in the tubular projection of the seal.

16. The laundry treatment device of claim 12, without a bellows or flexible hose between the filling connector and the seal.

17. A laundry treatment device comprising:

a housing:

a container suspended in the housing;

a seal connected to the housing and to the container, said seal having an opening; and a dispenser housing having a filling connector, said filling connector directly connecting the dispenser housing to the seal opening without a bellows or flexible inlet hose;

wherein the seal has an approximately tubular projection provided with said opening; and wherein the tubular projection is expandable when the filling connector is inserted at least partially therein.

18. The laundry treatment device of claim 17, wherein sealing connection between the tubular projection and the filling connector does not require a hose clamp.

19. The laundry treatment device of claim 17, wherein the filling connector has an end inserted in the tubular projection of the seal.

20. The laundry treatment device of claim 17, wherein the seal includes one or more folds in proximate to the opening.

21. A laundry treatment device comprising:

a housing:

a container suspended in the housing;

a seal connected to the housing and to the container, said seal having an opening; and a dispenser housing having a filling connector, said filling connector directly connecting the dispenser housing to the seal opening without a bellows or flexible inlet hose;

wherein the seal has an approximately tubular projection provided with said opening; and wherein the tubular projection includes a section that extends from a base body of the seal, and wherein the section creates a spacing between an edge of the filling connector and the base body, to decouple the filling connector from the container.

* * * * *